US006269748B1

(12) United States Patent
Rudoy et al.

(10) Patent No.: US 6,269,748 B1
(45) Date of Patent: Aug. 7, 2001

(54) RELEASE MECHANISM

(75) Inventors: Edward Rudoy, Woodland Hills; Larry Leroy McCormick, Camarillo; Edwin E. Vega, Van Nuys; Craig W. Courtney, West Hills, all of CA (US)

(73) Assignee: NEA Electronics, Inc., Chatsworth, CA (US)

( * ) Notice: Subject to any disclaimer, the term of this patent is extended or adjusted under 35 U.S.C. 154(b) by 0 days.

(21) Appl. No.: 09/336,237

(22) Filed: Jun. 18, 1999

Related U.S. Application Data

(60) Provisional application No. 60/089,796, filed on Jun. 18, 1998.

(51) Int. Cl.[7] ..... F42B 15/38
(52) U.S. Cl. ..... 102/377; 102/377; 102/378
(58) Field of Search ..... 102/377, 378

(56) References Cited

U.S. PATENT DOCUMENTS 3,817,179 * 6/1974 Ludtke et al. ..... 102/4
3,863,570 * 2/1975 Bixby ..... 102/49.4
3,992,999 * 11/1976 Chevrier et al. ..... 102/70 B
4,163,535 * 8/1979 Austin ..... 244/17.23
4,171,663 * 10/1979 Day et al. ..... 89/1
4,230,040 * 10/1980 Bjork et al. ..... 102/13
5,067,386 * 11/1991 Shiovitz et al. ..... 89/1.808
5,115,708 * 5/1992 Spariat et al. ..... 89/1.14
5,218,165 * 6/1993 Cornelius et al. ..... 102/378

OTHER PUBLICATIONS

Specification Sheet—Used for more than 1 year before filing data. G&H Technology, Inc. –Nonexplosive Actuator (NEA) Model 8014Tension Link.

* cited by examiner

*Primary Examiner*—Charles T. Jordan
*Assistant Examiner*—Lulit Semunegus
(74) *Attorney, Agent, or Firm*—Lewis B. Sternfels

(57) ABSTRACT

A device for retaining an object and then releasing that object upon actuation, the device utilizing an actuator that resists less force than that exerted by said object, and is adapted for use with a V-band clamp.

16 Claims, 2 Drawing Sheets

Fig. 3
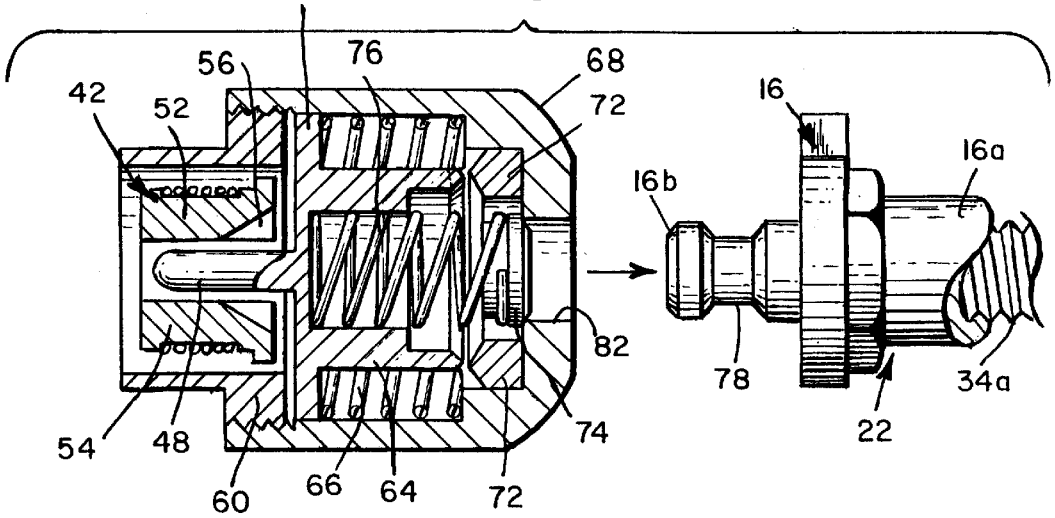
Fig. 5b.
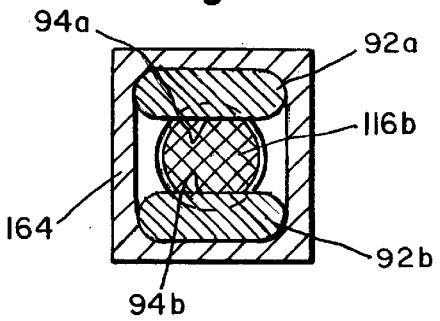
Fig. 4.
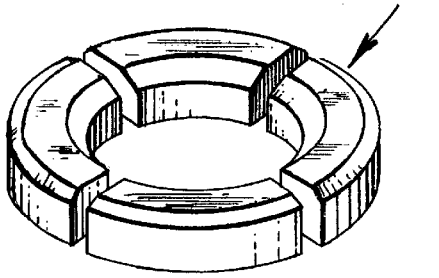
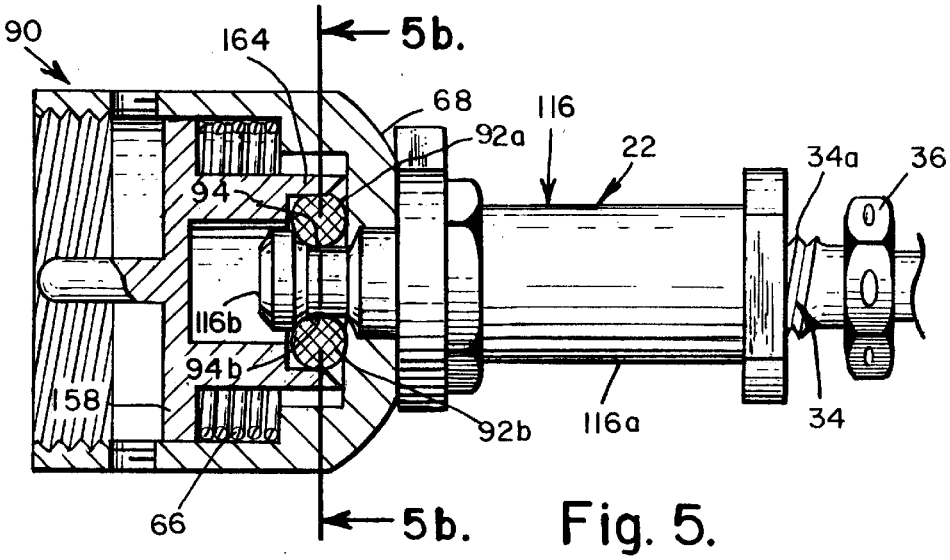
Fig. 5.

RELEASE MECHANISM

CROSS-REFERENCE TO RELATED APPLICATION

This application claims the benefit of U.S. Provisional Application Ser. No. 60/089,796, filed Jun. 18, 1998.

REFERENCE REGARDING FEDERAL SPONSORSHIP

Not Applicable

REFERENCE TO MICROFICHE APPENDIX

Not Applicable

BACKGROUND OF THE INVENTION

1. Field of the Invention

The present invention relates to non-explosive release devices.

2. Description of Related Art and Other Considerations

Prior art release devices utilized actuators which restrained all of the load to be released. Obviously, such devices were subjected to enormous stress forces. This required expensive and cumbersome heavy-duty actuators. Additionally, most non-explosive actuators typically required high watt-hours of electrical current for actuation, requiring a larger power source, particularly disadvantageous in weight sensitive applications, such as aerospace.

Additionally, such prior art devices were particularly cumbersome and difficult to install on a V-band or Marmon clamp, as applying the full force of the restrained load directly to the actuator meant that the trigger mechanism had to be set at the same time that tension or load was placed on the system (i.e., as the V-band is tightened securely around the object to be released). What is needed is a release device in which the triggering mechanism must resist only a minimal amount of force, is adapted for use in a V-band clamp, and may be set for actuation independently of the load placed on the system.

SUMMARY OF THE INVENTION

The present invention provides a device for restraining and then releasing loads in which the triggering mechanism must resist a minimal amount of force.

In a first embodiment, the present invention provides a release mechanism for releasing objects, actuator means for resisting movement of a transmission means until actuation, securing means for releaseably securing said object to the release mechanism, and linkage means for transmitting movement of said transmission means to said securing means wherein the securing means releases said object upon transmission of said movement of said transmission means by the linkage means to said securing means.

In a second embodiment, the present invention provides a release mechanism having a base portion (e.g., a left or a right release mechanism) and a release portion (e.g., a separation member), for restraining and releasing objects, a release pin having a first end located in the release portion and interconnected with the object, and a second end comprising a circumferential locking groove capable of being releaseably engaged with said base portion, a sectored or multi-part annular retainer movably located in the base portion and having a restraining position and bearing against and restraining the locking groove and release pin relative to the base in said restraining position, for preventing movement of the release pin while the annular retainer is in its restraining position, a collar or rim portion located in the base portion, movable between a first and second position, for restraining movement of the sectored annular retainer when the collar is in said first position and allowing movement of the sectored annular retainer when in said second position, and an actuator located in said base portion and having a latched and unlatched condition, resisting movement of the collar from the first position to the second when the actuator is in said latched condition, wherein activation of the actuator causes the actuator to assume said unlatched condition, allowing the collar to move from said first position to said second position, releasing the annular retainer and releasing the release pin.

In other embodiments, the sectored, multi-part annular retainer has at least three sectors and is toroidal in shape, and in a particular embodiment, has four sectors, a release pin aperture defined by the base portion, which also comprises: a debris plug or cover near and bearing upon the second end of the release pin, said debris cover having a larger cross-sectional surface area than said release pin aperture; a debris compression spring, connected at one end to the debris cover and at the other end to the base portion, whereby release of the release pin enables the debris cover and debris compression spring to urge the release pin through the release pin aperture and to block the release pin aperture, a compression spring for urging the collar from said first position to said second position, a V-band clamp having two ends, a first end and a second end, a second release mechanism interconnected in series with the first release mechanism between the first end and the second end of said V-clamp, whereby release of either release mechanism releases the V-band clamp, and the second release mechanism is adjustably connected (e.g., by a turnbuckle) to the first release mechanism and further comprises a second base portion and a second release portion, and said V-band clamp further comprises: a first V-band collar attached to the first end of the V-band and defining a first V-band aperture, the first release mechanism being inserted through the first V-band collar, with the base portion substantially on the band side and the release portion substantially on the connection side; and a second V-band collar attached to said second end of the V-band and defining a second V-band aperture, said second release mechanism being inserted into the second V-band collar, with the second base portion substantially on the band side and the second release portion substantially on the connection side, wherein adjustment of the connection between the two release mechanisms will alter the circumference of a loop formed by the V-band and the two release mechanisms, and activation of either of the release mechanisms will release said loop.

In a third embodiment the present invention provides a release pin having two ends, a first end located in the release portion and interconnected with the restrained object, and a second end comprising at least one locking indentation capable of being releaseably engaged with the base portion, at least one retainer or locking pin movably located in said base portion and having a restraining position and bearing against and restraining said locking indentation and release pin relative to said base in said restraining position, for preventing movement of the release pin while said at least one retainer pin is in its restraining position, a collar located in said base portion, movable between a first and a second position, for restraining movement of said at least one retainer pin when the collar is in said first position and allowing movement of said at least one retainer pin when in said second position; and an actuator located in said base portion and having a latched and unlatched condition, resisting movement of the collar from the first position to the second when the actuator is in said latched condition; wherein activation of the actuator causes the actuator to assume said unlatched condition, allowing the collar to move from said first position to said second position, releasing said at least one retainer pin and releasing the release pin.

These and other features and advantages of this invention will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIG. 3 is a schematic view of the left release mechanism (10), the left side portion (22) and part of the turnbuckle (24) and right side portion (18) of the present invention in its released position.

FIG. 4 is an isometric view of the four-part restraining or multi-part collar of the present invention.

FIG. 5 is a schematic view of a portion of an alternative release mechanism (90), the left side portion (22) and part of the turnbuckle, viz., nut (24) and shaft (36) of the present invention in its restrained position.

FIG. 5*b* is a cross-sectional view along line 5*b*—5*b* of FIG. 5.

DETAILED DESCRIPTION OF THE INVENTION

The present invention provides a release mechanism to restrain significant force, such as hoop-tension force applied at the ends of a V-band or Marmon clamp, and release an object (e.g., release the ends of a Marmon clamp) upon the application of an electrical, mechanical or other stimulus to a single release mechanism or to either (or both) redundant tension release mechanisms.

The present invention may be used in any number of applications, such as a single release mechanism in which an object to be released is directly attached to a releaseable portion of the present invention. Upon actuation, the present invention will release the releaseable portion, allowing the object to move freely away from the mechanism (and from whatever platform to which the mechanism is attached). The present invention may be most easily described in the context of an embodiment in which two release mechanisms are used to secure and then release an object held by a Marmon clamp.

Figure 1:
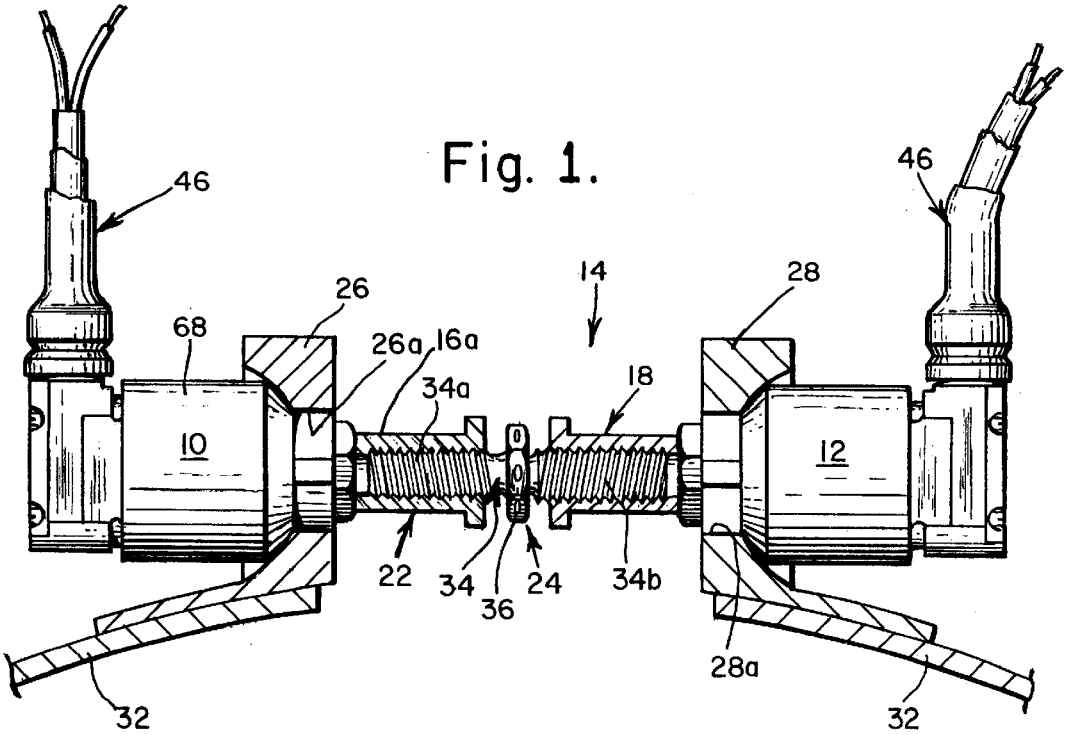
FIG. 1 is a top plan view of the release mechanism of the present invention, showing the mechanism in its restrained position.

Referring to FIG. 1, the above-referenced embodiment of the present invention comprises two release mechanisms, a left release mechanism 10 and a right release mechanism 12. The two release mechanisms are mirror images of each other, so only the left release mechanism 10 need be discussed in detail. The two release mechanisms 10 & 12 are secured together via a separation member 14. The separation member 14 has a right side portion 18, a left side portion 22, and a turnbuckle 24. As discussed below, the left side portion 22 includes a release pin 16, and the right side portion 18 includes a second release pin (not shown) on the opposite end of the separation member 14. The right side portion 18 and the left side portion 22 are interconnected by turnbuckle 24.

Each release mechanism 10 & 12 abuts against a V-band collar (left V-band collar 26 and right V-band collar 28), which are rigidly attached to the respective ends of a V-band clamp 32. The left release mechanism 10 passes partially through aperture 26*a* in the left V-band collar 26 and the right release mechanism 12 passes partially through aperture 28*a* in the right V-band collar 28. Thus, in addition to securing the left release mechanism 10 to the right release mechanism 12, the turnbuckle 24 secures the left V-band collar 26 to the right V-band collar 28, creating a continuous loop formed by the V-band 32, left V-band collar 26, left release mechanism 10, separation member 14, right V-band collar 28, and right release mechanism 12.

The V-band clamp secures the object(s) to be released (not shown) either to other objects to be released or to a non-released platform. The release object can take any number of forms, such as a device in which two halves are mated at the V-band, with a lip protruding from each half into the space defined by the V-band. Other release objects include those in which two or more segments are bundled together by the V-clamp, with the meeting points of the various segments forming exterior lines running perpendicular to the V-clamp. As noted above, in other embodiments the release object may be directly attached to the left side portion 22 of the separation member 14, which in turn may be releaseably secured to a single release mechanism, such as left release mechanism 10.

Returning to the Marmon-clamp embodiment, the turnbuckle 24 comprises a nut 36 rigidly mounted to a shaft 34, said nut 36 being located near the center of the shaft 34. The shaft 34 comprises portions 34*a* and 34*b* which extend from the left and right sides of the nut 36. The portion 34*b* of the shaft 34 on the right side of the nut 36 is threaded in the reverse of the portion 34*a* of the shaft 34 on the left side of the nut 36. The shaft 34 is threaded into the left side portion 22 and the right side portion 18, with each side portion 18 & 22 threaded to correspond to the end of the shaft it is to contain, and thus each side portion 18 & 22 is threaded in the reverse of the other. By rotating the nut 36, each end of the shaft 34 engages a respective one of the side portions 18 & 22 of separation member 14 to tighten the V-band clamp 32, while turning the nut 36 in the opposite direction disengages the threaded ends of the shaft 34.

Figure 2:
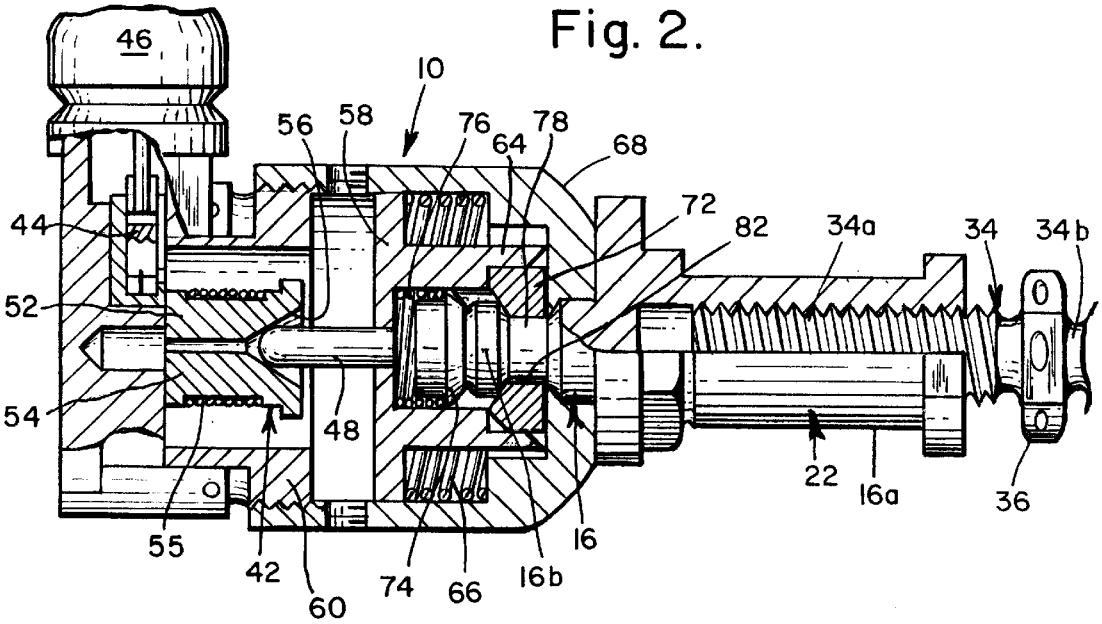
FIG. 2 is a schematic view (rotated 90° with respect to the view depicted in FIG. 1), of the left release mechanism (10), the left side portion (22) and part of the turnbuckle (24) and right side portion (18) of the present invention in its restrained position.

Viewing FIGS. 2 and 3, the left side portion 22 includes the release pin 16 at an end distant from the nut 36. The release pin 16 includes ends 16*a* and 16 *b*. First end 16*b* is secured to one end of left side portion 22 and passes into the left release mechanism 10 through a release pin aperture 82. Second end 16*a* is internally threaded for receipt of threads 34*a* of shaft 34. As discussed below, the release pin 16 is held securely within the left release mechanism 10 until activation, at which point it is released.

Left release mechanism 10 includes a triggering actuator 42. A variety of devices may be employed as an actuator, such as mechanical or electronic servo mechanisms or any mechanism capable of resisting a minimal amount of force until actuation. In a particular embodiment designed for a Marmon clamp subjected to hoop tension of approximately 2800 pounds, the triggering actuator should be able to resist force of approximately one hundred and forty pounds. One such device is the triggering actuator described in U.S.

patent application Ser. No. 09/270,914, of the inventors of the present invention, which has two conductive posts 44 which are connected to actuation wires 46. When the system is activated, a weak amperage electrical signal is transmitted through the actuation wires 46. The conductive posts 44 are connected to the two ends of a fuse wire loop (not shown). That fuse wire loop is adapted to fail when the current exceeds a predetermined level. When the fuse wire loop fails, a supporting or restraining wire, which is coiled around two initiator segments 52 & 54, uncoils to its natural unrestrained size, allowing the actuator to separate into the two initiator segments 52 & 54. The initiator segments 52 & 54 have a cone-shaped opening 56 facing in the direction of release pin 16.

The left release mechanism 10 includes a plunger shaft 48 which rests against the cone-shaped opening 56 formed by the initiator segments 52 & 54. The opposite end of the plunger shaft 48 is rigidly mounted to a restraining platform 58. The restraining platform 58 also has a rim portion 64 in the form of a circumferential collar mounted perpendicularly thereto on the side opposite the plunger shaft 48.

The left release mechanism 10 has an actuator compression spring 66, which is resisted at one end by the restraining platform 58 and at the other end by a frame 68 of the left release mechanism 10, thus urging the restraining platform 58 towards the triggering actuator 42. In a preferred embodiment, the actuator compression springs 66 exert approximately one hundred and forty pounds. of force in their compressed state. Before separation, the initiator segments 52 & 54 in their closed position (which are capable of resisting one hundred pounds of force) restrain the movement of the plunger shaft 48 and its connected restraining platform 58.

FIG. 2 shows that prior to actuation, the rim portion 64 restrains lateral movement of a multi-part collar (or sectored annular retainer) 72. In a preferred embodiment, the multi-part collar 72 (see FIG. 4) is circular and broken into four segments or sectors. However, multi-part collars having two, three or some other number of segments may also be employed.

The present invention also includes a debris cover or plug 74 which abuts the second end 16*b* of the release pin 16 distant from the nut 36. On the side of the debris cover 74 distant from the release pin 16 is mounted one end of a debris cover compression spring 76, the other end of which is mounted to the restraining platform 58. The debris cover compression spring 76 urges the debris cover 74 toward the release pin 16, with approximately eight pounds of force.

The release pin 16 has a retaining groove 78 (see also FIG. 3) centered between the release pin ends 16*a* and 16*b* for holding the release pin 16 in position. The multi-part collar 72 fits into the retaining groove 78 and is held in place by the rim portion 64 of the restraining platform 58. In a preferred embodiment, the retaining groove 78 and the multi-part collar 72 have correspondingly angled surfaces such that the force moving the release pin 16 away from the restraining platform 58 will also urge the multi-part collar 72 laterally away from the release pin 16 and towards the rim portion 64, freeing the release pin 16 from retention within frame 68 and allowing the release pin to move out of the left release mechanism 10.

In operation, the user will secure a load to be restrained with the V-band 32, insert the left release mechanism 10 partially through the aperture 26*a* in left V-band collar 26 and insert the right release mechanism 12 partially though the aperture 28*a* in right V-band collar 28. The user will then insert the separation member 14 (comprising the right side portion 18 and the left side portion 22, with the turnbuckle 24 loosely connecting the two), and more specifically the release pins 16 into their respective release mechanisms 10 & 12. Turning the nut 36 will tighten the connection between the release mechanisms 10 & 12, to secure the load within the V-band 32. The release pin 16 will be secured by the multi-part collar 72 which, in turn, is held in place by the rim portion 64. Force from the load is thus resisted by the multi-part collar 72 as confined within the rim portion 64. The advantage afforded by this configuration is that the triggering actuator 42 need merely resist the force of the actuator compression springs 66 (perhaps one hundred and forty pounds), not that of the load (in this embodiment, the hoop force of about 2800 pounds).

Upon activation, the initiator segments 52 & 54 separate, allowing the plunger shaft 48 to be urged by the actuator compression springs 66 into and between the two initiator segments 52 & 54, causing the restraining platform 58 to also move toward the initiator segments 52 & 54. This in turn moves the rim portion 64 in the same direction, freeing the multi-part collar 72 to move laterally away from the release pin 16. The release pin 16 is urged away from the left release mechanism 10 by both the force of the load and by the debris cover compression spring 76 pressing against the debris cover 74. Thus the release pin 16. In moves away from the restraining platform 58. The debris cover compression spring 76 continues to bias the debris cover 74 away from the restraining platform 58 until it contacts and covers the release pin aperture 82 which then blocks further movement of the debris cover 74. This prevents debris from leaving the left release mechanism 10.

Because the force of the load to be restrained is borne by the multi-part collar 72, the rim portion, and the frame 68 of the release mechanisms 10 & 12, the only load, which must be borne by the triggering actuator 42, is that which is necessary to resist the actuator compression springs 66. As noted above, it has been found in this embodiment a that a load of about 2800 pounds requires only about one hundred and forty pounds of pressure on the triggering actuator 42.

In the Marmon clamp embodiment, release can be accomplished by actuation of either release mechanism. FIG. 3 shows a release accomplished by actuation of the left release mechanism 10; however actuation of the right release mechanism 12 (or both) will have the same result.

One alternative embodiment, shown in part in FIGS. 5 and 5*b*, utilizes an alternative release mechanism 90 which includes a pair of locking or retainer pins 92*a* and 92*b* in lieu of the multi-part collar or sectored annular retainer 72 of the Marmon clamp embodiment. The annular retaining groove on the release pin of the Marmon clamp embodiment is replaced with pair of indentations 94*a* and 94*b* that do not span the circumference of the release pin 16. Otherwise, these two embodiments are generally identical. In the alternative release mechanism 90, activation of the triggering actuator (e.g. actuator 42 shown in FIGS. 3 and 4) allows the actuator compression springs 66 to urge the plunger shaft 48 and the rim portion 64 towards the triggering actuator, which in turn eliminates the restraint on lateral movement of the locking pins 92 away from the indentations 94, to permit the force of the load to pull the release pin 16 out of the release pin aperture 82 and to release the load.

Additional embodiments and detail of the present invention are possible without violating the spirit of the invention.

What is claimed is:

1. A release mechanism for restraining an object subject to a first force and for releasing the object, said mechanism comprising:

actuator means for resisting a second force until actuation and upon actuation ceasing resistance to the second force, the second force being lesser than the first force;

transmission means, moveably mounted to said release mechanism and urged by the second force in a predetermined direction, the movement of said transmission means being resisted by said actuator means until actuation and upon actuation such resistance being reduced to a level lower than the second force;

securing means for releaseably securing the object to said release mechanism; and linkage means for transmitting movement of said transmission means to said securing means;

wherein said securing means releases the object upon transmission of the movement of said transmission means by the linkage means to said securing means.

2. A release mechanism having a base portion and a release portion, for restraining and releasing an object, said mechanism comprising:

a release pin having two ends, a first end located in said release portion and interconnected with said object, and a second end comprising a circumferential locking groove capable of being releaseably engaged with said base portion;

a sectored annular retainer movably located in said base portion and having a restraining position and bearing against and restraining said locking groove and release pin relative to said base portion in the restraining position, for preventing movement of said release pin while said annular retainer is in its restraining position;

a collar located in said base portion, movable between a first position and a second position, for restraining movement of said sectored annular retainer when said collar is in the first position and allowing movement of said sectored annular retainer when in the second position; and an actuator located in said base portion and having latched and unlatched conditions, resisting movement of said collar from the first position to the second position when said actuator is in the latched condition;

wherein activation of said actuator causes said actuator to assume the unlatched condition, allowing said collar to move from the first position to the second position, releasing said annular retainer and releasing said release pin.

3. The release mechanism of claim 2 wherein said sectored annular retainer has at least three sectors.

4. The release mechanism of claim 2 wherein said sectored annular retainer is toroidal in shape.

5. The release mechanism of claim 2 wherein said sectored annular retainer has four sectors.

6. A release mechanism having a base portion and a release portion, for restraining and releasing an object, said mechanism comprising:

a release pin having two ends, a first end located in said release portion and interconnected with the object, and a second end comprising a circumferential locking groove capable of being releaseably engaged with said base portion;

a sectored annular retainer movably located in said base portion and having a restraining position and bearing against and restraining said locking groove and said release pin relative to said base portion in the restraining position, for preventing movement of said release pin while said annular retainer is in its restraining position;

a collar located in said base portion, movable between a first position and a second position, for restraining movement of said sectored annular retainer when said collar is in the first position and allowing movement of said sectored annular retainer when in the second position; and an actuator located in said base portion and having latched and unlatched conditions, resisting movement of said collar from the first position to the second position when said actuator is in the latched condition;

wherein activation of said actuator causes said actuator to assume the unlatched condition, allowing said collar to move from the first position to the second position, releasing said annular retainer and releasing said release pin, and wherein the base portion has a release pin aperture, said base portion further comprising a debris cover located adjacent to and bearing upon said second end of said release pin, said debris cover having a larger cross-sectional surface area than that of the release pin aperture; and a debris compression spring, connected at one end to said debris cover and at the other end to said base portion;

whereby release of said release pin enables said debris cover and said debris compression spring to urge said release pin through the release pin aperture and to block the release pin aperture.

7. The release mechanism of claim 2 further comprising a compression spring for urging said collar from the first position to the second position.

8. A release mechanism having a base portion and a release portion, for restraining and releasing and object, said mechanism comprising:

a release pin having two ends, a first end located in said release portion and interconnected with the object, and a second end comprising at least one locking indentation capable of being releaseably engaged with said base portion;

at least one retainer pin movably located in said base portion and having a restraining position and bearing against and restraining said locking indentation and said release pin relative to said base portion in the restraining position, for preventing movement of said release pin while said at least one retainer pin is in its restraining position;

a collar located in said base portion, movable between first and second positions, for restraining movement of said at least one retainer pin when said collar is in the first position and allowing movement of said at least one retainer pin when in the second position; and an actuator located in said base portion and having latched and unlatched conditions, resisting movement of said collar from the first position to the second position when said actuator is in the latched condition;

wherein activation of said actuator causes said actuator to assume the unlatched condition, allowing said collar to move from the first position to the second position, releasing said at least one retainer pin and releasing said release pin.

9. The release mechanism of claim 8 further comprising a compression spring for urging said collar from the first position to the second position.

10. A release mechanism having a base portion and a release portion, for restraining and releasing an object, said mechanism comprising:

a release pin having two ends, a first end located in said release portion and interconnected with the object, and a second end comprising at least one locking indentation capable of being releaseably engaged with said base portion;

at least one retainer pin movably located in said base portion and having a restraining position and bearing against and restraining said locking indentation and said release pin relative to said base portion in the restraining position, for preventing movement of said release pin while said at least one retainer pin is in its restraining position;

a collar located in said base portion, movable between a first position and a second position, for restraining movement of said at least one retainer pin when said collar is in the first position and allowing movement of said at least one retainer pin when in the second position; and an actuator located in said base portion and having a latched condition and an unlatched condition, resisting movement of the collar from the first position to the second position when said actuator is in the latched condition;

wherein activation of said actuator causes said actuator to assume the unlatched condition, allowing said collar to move from the first position to the second position, releasing said at least one retainer pin and releasing said release pin, and wherein said base portion has a release pin aperture, said base portion further comprising a debris cover located adjacent to and bearing upon said second end of said release pin, said debris cover having a larger cross-sectional surface area than that of the release pin aperture; and a debris compression spring, connected at one end to said debris cover and at the other end to said base portion;

whereby release of said release pin allows the debris cover and said debris compression spring to urge said release pin through the release pin aperture and to block the release pin aperture.

11. A release mechanism assembly adapted for use in a V-band clamp having two ends, a first end and a second end, said release mechanism assembly comprising first and second mechanisms having a base portion and a release portion, for restraining and releasing and object, said first mechanism comprising:

a release pin having two ends, a first end located in said release portion and interconnected with the object, and a second end comprising a circumferential locking groove capable of being releaseably engaged with said base portion;

a sectored annular retainer movably located in said base portion and having a restraining position and bearing against and restraining the locking groove and said release pin relative to said base portion in the restraining position, for preventing movement of said release pin while said annular retainer is in its restraining position;

a collar located in said base portion, movable between first and second positions, for restraining movement of said sectored annular retainer when said collar is in the first position and allowing movement of said sectored annular retainer when in the second position; and an actuator located in said base portion and having latched and unlatched conditions, resisting movement of said collar from the first position to the second position when said actuator is in the latched condition;

wherein activation of said actuator causes said actuator to assume the unlatched condition, allowing said collar to move from the first position to the second position, releasing said annular retainer and releasing said release pin, and said second release mechanism interconnected in series with said first release mechanism between the first end and the second end of said V-band clamp, whereby release of either of said release mechanisms releases the V-band clamp.

12. The device of claim 11 wherein said second release mechanism is adjustably connected to said first release mechanism and further comprises a second base portion and a second release portion, and said V-band clamp further comprises:

a first V-band collar attached to said first end of the V-band clamp and defining a first V-band aperture, the aperture having two sides, a band side adjacent to the V-band clamp and an attachment side which is distant from the V-band clamp, said first release mechanism being inserted through the first V-band collar, with said base portion substantially on the band side and said release portion substantially on the connection side; and a second V-band collar attached to said second end of the V-band clamp and defining a second V-band aperture, the aperture having two sides, a band side adjacent to the V-band clamp and an attachment side which is distant from the V-band clamp, said second release mechanism being inserted into the second V-band collar, with the second base portion substantially on the band side and the second release portion substantially on the connection side;

wherein adjustment of the connection between said two release mechanisms will alter the circumference of a loop formed by the V-band clamp and said two release mechanisms, and activation of either of said release mechanisms will release said loop.

13. A release mechanism for restraining and releasing an object, comprising:

a base portion;

a release portion;

a release agent having one part coupled to said release portion for interconnection with the object, and another part positionable in said base portion;

a retainer assembly in said base portion couplable with said release agent for retention thereof in, and for release thereof from said base portion;

a release agent aperture located in said base portion;

a cover having a larger cross-sectional surface area than the release agent aperture and located adjacent to and bearing upon said release agent one part;

a compression spring, coupled between said cover and said base portion;

whereby, upon release of said release agent, said cover is biased by said compression spring to urge said release agent through, and thereafter to block the release agent aperture.

14. A release mechanism assembly, comprising first and second mechanisms, adapted for use in a clamp having first and second ends, for restraining and releasing an object, in which:

said first mechanism includes a base portion, a release portion, a release agent having one part coupled to said release portion for interconnection with the object, and another part positionable in said base portion, a retainer assembly in said base portion having an arrangement therewith for coupling with, and uncoupling from said release agent for retention thereof in, and for release thereof from said base portion, and an actuator located in said base portion and having latched and unlatched conditional arrangements with said retainer assembly, to effect the coupling and uncoupling thereof; and said second release mechanism has an interconnection in series with said first release mechanism between the first and second ends of the clamp, whereby release of either of said first and second release mechanisms releases the clamp.

15. A release mechanism assembly according to claim 14 in which said second mechanism includes a base portion, a release portion, a release agent having one part coupled to said release portion for interconnection with the object, and another part positionable in said base portion, a retainer assembly in said base portion having an arrangement therewith for coupling with, and uncoupling from said release agent for retention thereof in, and for release thereof from said base portion, and an actuator located in said base portion and having latched and unlatched conditional arrangements with said retainer assembly, to effect the coupling and uncoupling thereof; and said second release mechanism has an interconnection in series with said first release mechanism between the first and second ends of the clamp, whereby release of either of said first and second release mechanisms releases the clamp.

16. The device of claim 14 wherein said second release mechanism is adjustably connected to said first release mechanism and further comprises a second base portion and a second release portion, and the clamp further comprises:

a first collar attached to said first end of the V-band clamp and defining a first aperture having two sides, a band side adjacent to the clamp and an attachment side which is distant from the clamp, said release mechanism of claim 2 being inserted through the first collar, with said base portion substantially on the band side and said release portion substantially on the connection side; and a second collar attached to said second end of the clamp and defining a second aperture having two sides, a band side adjacent to the clamp and an attachment side which is distant from the clamp, said second release mechanism being inserted into the second collar, with said second base portion substantially on the band side and said second release portion substantially on the connection side;

wherein adjustment of the connection between said two release mechanisms will alter the circumference of a loop formed by the clamp and said two-release mechanisms, and activation of either of said release mechanisms will release said loop.

* * * * *